United States Patent [19]

Abraham et al.

[11] 4,342,122

[45] Aug. 3, 1982

[54] PROTECTIVE HEADGEAR

[75] Inventors: Carl J. Abraham, Great Neck; Malcolm Newman, Huntington, both of N.Y.

[73] Assignee: Alan H. Levine, Great Neck, N.Y.

[21] Appl. No.: 196,889

[22] Filed: Oct. 14, 1980

[51] Int. Cl.[3] ..... A41D 13/00

[52] U.S. Cl. ..... 2/424; 2/9

[58] Field of Search ..... 2/9, 10, 424, 425

[56] References Cited

U.S. PATENT DOCUMENTS

| | | | |
|---|---|---|---|
| 2,904,791 | 9/1959 | Chandler | 2/9 |
| 2,929,070 | 3/1960 | Novak | 2/9 |
| 3,787,895 | 1/1974 | Belvedere | 2/9 |
| 4,086,664 | 5/1978 | Humphrey et al. | 2/9 |

FOREIGN PATENT DOCUMENTS

| | | | |
|---|---|---|---|
| 469190 | 2/1952 | Italy | 2/9 |

*Primary Examiner*—Peter P. Nerbun

*Attorney, Agent, or Firm*—Alan H. Levine

[57] ABSTRACT

A protective headgear comprising a helmet and a face mask of flexible material secured to the helmet. When a force capable of causing injury to the headgear wearer is applied to the face mask, the mask deflects to a significant degree, without fracturing, with respect to the helmet. The deflection may take place entirely within the material of the face mask, or the deflection may in part take place within the attachments resiliently securing the face mask to the helmet. The face mask is preferably fabricated of an elastomeric material.

4 Claims, 2 Drawing Figures

PROTECTIVE HEADGEAR

Figure 1:
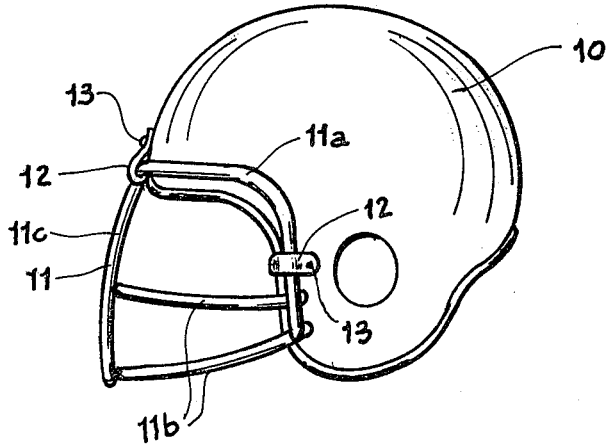

This invention relates to protective headgear, and more particularly to a combination helmet and face mask such as is commonly worn by participants in certain types of sporting events.

While the invention finds its primary utility with respect to football helmets and face masks, it is to be understood that it is applicable to any sport or activity in which such protection for participants is considered desirable.

Football helmets, originally of leather, have been used for almost 100 years to provide protection against head injury. Soon after the introduction of rigid plastic helmets around 1950, face masks were added to the helmets to guard against injuries to the nose, teeth, and other parts of the face. Ironically, while face masks have served successfully to minimize injuries to the face, they have been responsible for increasing the severity of injuries to the neck and spine of those who wear them.

Typically, face masks are made of a rigid material, either a metal or a hard plastic which simulates the rigidity of metal, presumably on the theory that the mask must be rigid to perform its protective function. Furthermore, in most cases, the rigid mask is rigidly attached to the helmet, although it has been suggested that the mask be separable from the helmet upon receiving an impact exceeding some predetermined force, and it has also been suggested that the face mask be resiliently secured to the helmet.

Because the helmet and face mask are in most cases a rigid system held tightly on the head, the force of a blow received by the face mask is substantially fully transmitted through the helmet to the head of the wearer. As a result, a force of sufficient magnitude can and does cause serious neck and spine injury. More specifically, a blow to the mask directed full face or upwardly produces injury of the whiplash variety, while a sideward blow to the mask causes a quick injury-engendering rotation of the neck.

It is an object of the present invention to provide a helmet and face mask combination capable of absorbing the major portion of a blow to the face mask, so that only a minor portion of the force of the blow is transmitted to the neck of the wearer.

It is another object of the invention to provide a helmet and face mask combination wherein the face mask is made of a flexible material which deforms to absorb the force of a blow applied to it.

The invention contemplates that the flexible face mask may be secured to the helmet by a resilient attachment arrangement, so that the force of a blow to the mask may be taken up both by deformation of the mask itself and by stressing of the resilient attachment.

Additional objects and features of the invention will be apparent from the following description in which reference is made to the accompanying drawings.

Figure 2:
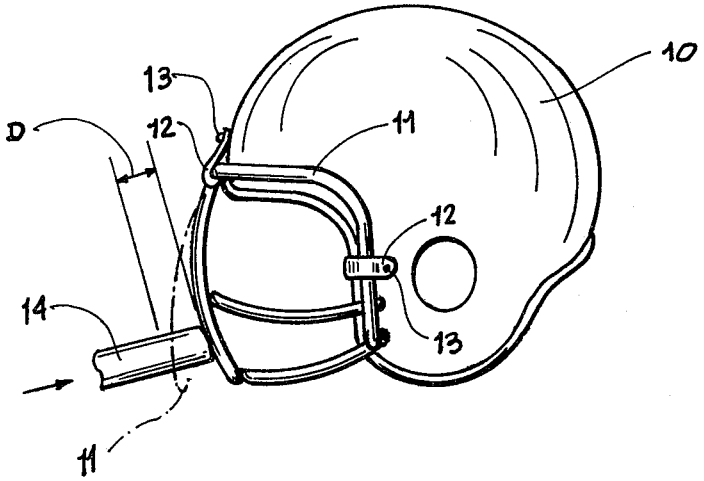

In the drawings:

FIG. 1 is a side elevational view of a combination football helmet and face mask according to the present invention; and FIG. 2 is a view of the helmet and face mask similar to FIG. 1, but showing the face mask being deformed by an applied force.

In the illustrative embodiment of the invention shown in the drawings, the helmet 10 may be entirely conventional, and formed of a rigid plastic. In shape, the face mask 11 may also be conventional, comprising a generally inverted U-shaped bar 11*a*, two curved horizontal bars 11*b*, and a curved vertical bar 11*c*, all firmly interconnected at their points of intersection. In this embodiment, face mask 11 is rigidly secured to helmet 10 by four looped straps 12 (only two being shown), riveted at 13 to the helmet, through which portion 11*a* of the face mask passes.

According to the present invention, the face mask 11 is made of a flexible material which deforms when struck by a blow having a force which is within the range of magnitudes encountered during the play of a football game. The face mask must be flexible enough to deform and hence absorb the energy of a blow, and yet not be so flexible that it fails to protect the face of the wearer. A face mask admirably serves the purpose of this invention if when loaded by a tool 14 (FIG. 2) with a force of between 200 and 1000 pounds the mask deflects with respect to the helmet, without fracturing, between two and four inches. In FIG. 2, this deflection is indicated by the distance "D" between the original unloaded position of the mask, shown in broken lines, and the loaded position of the mask, shown in solid lines. In the load test referred to above, the operative face of tool 14, which contacts the face mask, has a surface area of at least six square inches, the tool is applied to the point of the mask spaced farthest from the wearer's face, and the force is applied in a direction generally perpendicular to the plane of the face of the wearer.

As pointed out above, the face mask of this invention is formed of a material which permits it to flex at least several inches without fracture. In contrast, the rigid face masks conventionally employed will fracture well before they flex even one or two inches.

The face mask of this invention is preferably formed of an elastomeric material, such as polyurethane or silicone. However, thermoplastic or even thermosetting materials can be used if they meet the flexure test described above. Furthermore, bars 11*a*, 11*b*, and 11*c* of which the face mask is constructed are preferably formed of hollow tubular material which deforms more readily upon impact. Heretofore, these bars have been made of solid rod stock.

The drawings illustrate a rigid securement between the face mask 11 and helmet 10. Alternatively, the face mask may be resiliently mounted on the helmet. An example of such a mounting is shown in U.S. Pat. No. 3,854,146. Should a resilient mounting be employed, the deflection described above of the face mask with respect to the helmet takes place partially in the material of the face mask and partially in the resilient mounting between the mask and helmet.

On occasion, a conventional face mask made of metal or hard plastic breaks, leaving jagged edges which can cause injury. A flexible face mask, according to this invention, is much less likely to break; however, should a break occur, the edges will be smoother and softer than those of a broken rigid mask, and hence far less likely to cause injury.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A protective headgear comprising:
(a) a helmet,
(b) a face mask of flexible material, and
(c) means securing the face mask to the helmet,
(d) the helmet and face mask being so constructed that when a force in the range of 200 to 1000 pounds is applied in a direction generally perpendicular to the plane of the face of the wearer, there is a deflection of the face mask with respect to the helmet in the range of two to four inches, the deflection being unaccompanied by fracture of the mask, and the face mask remaining attached to the helmet throughout the time the force is applied.

2. A protective headgear comprising:
(a) a helmet,
(b) a face mask of flexible material, and
(c) means rigidly securing the face mask to the helmet,
(d) the helmet and face mask being so constructed that when a force capable of causing injury to the headgear wearer is applied to the face mask, the mask deflects throughout its thickness to a significant degree, without fracturing, with respect to the helmet, the deflection taking place entirely within the flexible material of the face mask.

3. A protective headgear comprising:
(a) a helmet,
(b) a face mask of flexible material, and
(c) means resiliently securing the face mask to the helmet,
(d) the helmet and face mask being so constructed that when a force capable of causing injury to the headgear wearer is applied to the face mask, the mask deflects to a significant degree, without fracturing, with respect to the helmet, while the face mask remains attached to the helmet, part of the deflection of the mask taking place in the securing means, and part of the deflection taking place within and throughout the thickness of the flexible material of the face mask.

4. A protective headgear comprising:
(a) a helmet,
(b) a face mask of flexible, interconnected hollow tubular bars, and
(c) means securing the face mask to the helmet,
(d) the helmet and face mask being so constructed that when a force capable of causing injury to the headgear wearer is applied to the face mask, the mask deflects throughout its thickness to a significant degree, without fracturing, with respect to the helmet, while the face mask remains attached to the helmet.

* * * * *